US006826939B2

(12) United States Patent
Kanno

(10) Patent No.: US 6,826,939 B2
(45) Date of Patent: Dec. 7, 2004

(54) METHOD AND DEVICE FOR DETACHING PLATE THICKNESS IN PRESS

(75) Inventor: Kazuhiro Kanno, Kanagawa (JP)

(73) Assignee: Amada Company, Ltd., Kanagawa (JP)

( * ) Notice: Subject to any disclaimer, the term of this patent is extended or adjusted under 35 U.S.C. 154(b) by 292 days.

(21) Appl. No.: 10/182,742

(22) PCT Filed: Feb. 15, 2001

(86) PCT No.: PCT/JP01/01081

§ 371 (c)(1),
(2), (4) Date: Aug. 15, 2002

(87) PCT Pub. No.: WO01/60541

PCT Pub. Date: Aug. 23, 2001

(65) Prior Publication Data

US 2003/0019266 A1 Jan. 30, 2003

(30) Foreign Application Priority Data

Feb. 18, 2000 (JP) ..... 2000-040932

(51) Int. Cl.[7] ..... B21C 51/00
(52) U.S. Cl. ..... 72/19.6; 72/20.2; 72/31.11
(58) Field of Search ..... 72/16.9, 18.8, 72/19.6, 19.7, 20.1, 20.2, 21.5, 31.1, 31.11

(56) References Cited

U.S. PATENT DOCUMENTS 5,031,431 A * 7/1991 Naito ..... 72/21.5
6,581,427 B2 * 6/2003 Gerritsen ..... 72/31.11

FOREIGN PATENT DOCUMENTS

| | | |
|---|---|---|
| JP | 02030327 | 1/1990 |
| JP | 06304622 | 11/1994 |
| JP | 07275946 | 10/1995 |
| JP | 09136116 | 5/1997 |
| JP | 10180499 | 7/1998 |

OTHER PUBLICATIONS

English Language Abstract for JP Appln. No. 02–030327.
English Language Abstract for JP Appln. No. 09–136116.
English Language Abstract for JP Appln. No. 10–180499.
English Language Abstract for JP Appln. No. 06–304622.
English Language Abstract for JP Appln. No. 07–275946.

* cited by examiner

*Primary Examiner*—Lowell A. Larson
(74) *Attorney, Agent, or Firm*—Greenblum & Bernstein, P.L.C.

(57) ABSTRACT

A ram descends due to its own weight and pressure of a rod-side cylinder chamber of a hydraulic cylinder which vertically moves the ram is detected by an oil pressure detector. A determination section detects a position at which a punch attached to the ram contacts an upper surface of a workpiece, based upon a change in the detected pressure. When the upper surface of the workpiece is detected, a plate thickness calculation section calculates a plate thickness of the workpiece based on an upper surface position of a die, that is known in advance and stored in a memory.

12 Claims, 6 Drawing Sheets

METHOD AND DEVICE FOR DETACHING PLATE THICKNESS IN PRESS

TECHNICAL FIELD

This invention relates to a plate thickness detection method and a plate thickness detection apparatus for a press which presses a workpiece by the cooperation of a punch and a die.

BACKGROUND ART

As a conventional plate thickness detection apparatus in a press or particularly in a press brake, there is known one described in, for example, Japanese Patent Application Laid-Open No. 10-180499. The press brake disclosed therein detects a pinching point at which an upper die contacts with a workpiece from a change in the torque of a servo motor which drives a hydraulic pump which supplies hydraulic oil to a hydraulic cylinder for driving a ram.

However, a plate thickness detection method for detecting a pitching point from a change in pressurizing side pressure in a hydraulic cylinder has the following disadvantages. Since a change point at which pressure rises is detected while a pressurizing side (cylinder head side) having a large cross-sectional area in the cylinder chamber is pressurized, it is difficult to detect the pressure change point particularly if a press becomes large in size.

Further, since the pressurizing side is pressurized, a pressure force acts on a workpiece and the workpiece is bent if the detection of the pinching point delays, whereby the plate thickness of the workpiece cannot be accurately detected.

This invention has been made in view of the above-stated disadvantages of the conventional art and an object of this invention is to provide a plate thickness detection method and a plate thickness detection apparatus in a press capable of accurately detecting thickness of a workpiece plate without bending the workpiece.

DISCLOSURE OF THE INVENTION

To attain the above object, a plate thickness detection method for a press according to the present invention in a first aspect, comprises the following steps of: descending a ram from a certain height position; detecting pressure of hydraulic oil discharged from a rod-side cylinder chamber at this time; detecting time at which a punch contacts with a workpiece on the die, from a change of the detected pressure; detecting upper and lower positions of the ram at this time; obtaining a plate thickness of the workpiece from the detected height position of the ram and a set height between the certain height known in advance and an upper surface of the die: and vertically moving the ram to which the punch is attached, based on the obtained plate thickness of the workpiece, and pressing the workpiece cooperatively by the punch and the die.

Accordingly, to detect the upper surface position of the workpiece based on which the plate thickness of the workpiece is detected, the ram is descended from a certain height position, the pressure of the hydraulic oil discharged from the rod-side cylinder chamber of the hydraulic cylinder at this time is detected, and the position at which the punch attached to the ram contacts with the workpiece is detected from a change of this detected pressure. Therefore, the change of the ram position is detected more sensitively than a case where the pressure of the cylinder-head side cylinder chamber having a large cross-sectional area in the cylinder chamber is detected. In addition, if the upper surface of the workpiece is detected, the plate thickness of the workpiece can be calculated from this detected upper surface position and a set height between the certain height position of the ram known in advance and the upper surface position of the die.

In a plate thickness detection method for a press according to the invention in a second aspect dependent on the first aspect, the ram is descended by a self-weight; the pressure of the hydraulic oil discharged from the rod-side cylinder chamber at this time is detected; and the time at which the punch contacts with the workpiece is detected from the change of the detected pressure.

With the above-stated constitution, the ram to which the punch is attached is descended by the self-weight, and the time at which the punch contacts with the workpiece is detected from a change of the pressure of the hydraulic oil discharged from the rod-side cylinder chamber at this time. While the ram is being descended, the hydraulic oil is not forced into the cylinder head-side cylinder chamber and sucked by negative pressure which is generated by the descent of the piston.

Accordingly, even if the detection that the punch contacts with the workpiece is delayed only the self-weight of the ram and the like acts on the workpiece and it is thereby possible to prevent the workplace from being bent In a plate thickness detection method for a press according to the invention in a third aspect dependent on the first or second aspect, if the ram is to be descended by the self-weight, the ram is descended at a speed equal to or lower than a ram self-weight maximum falling speed at which the workpiece is not bent even if the punch contacts with the workpiece.

Accordingly, if the ram is to be descended by the self-weight, the ram is descended at a speed equal to or lower than a ram self-weight maximum falling speed at which the workpiece is not bent even if the punch contacts with the workpiece. Therefore, it is possible to prevent the workpiece from being bent even if the punch contacts with the workplace.

In a plate thickness detection method for a press according to the invention in a fourth aspect dependent on one of the first to third aspects, time at which the pressure of the hydraulic oil discharged from the rod-side cylinder chamber changes from the pressure by the self-weight to atmospheric pressure is detected as the time at which the punch contacts with the workpiece.

With the above-stated constitution, the pressure of the hydraulic oil discharged from the rod-side cylinder chamber detected when the ram is descended, is the pressure following the descent caused by the self-weight of the ram, the punch and the like. However, if the punch contacts with the workpiece, the pressure by the self-weight is eliminated, so that atmospheric pressure is detected. Therefore, it is possible to determine that the punch contacts with the workpiece when this atmospheric pressure is detected.

A plate thickness detection method for a press according to the invention in a fifth aspect, comprises the following steps of: descending a ram from a certain height position while controlling a descent speed, and detecting a ram descent position; detecting a ram stop position from a change of this detected ram position: determining the detected stop position as a position at which a punch contacts with a workpiece on the die; obtaining a plate thickness of the workpiece from the ram position which is determined as the position at which the punch contacts with the workpiece, and from a set height of a difference between the certain height known in advance and an upper surface of the die; and vertically moving the ram, to which the punch is attached, based on the obtained plate thickness of the workpiece, and pressing the workpiece cooperatively by the punch and the die.

Accordingly, to detect the upper surface position of the workpiece based on which the plate thickness of the workpiece is detected, the ram is descended from a certain height position while controlling a descent speed, a stop position is detected from a change of the ram descent position and this stop position is determined as the upper surface of the workpiece. Therefore, the change of the ram position is detected more sensitively than a case where the pressure of the cylinder-head side cylinder chamber having a large cross-sectional area in the cylinder chamber is detected. In addition, if the upper surface of the workpiece is detected, the plate thickness of the workpiece can be calculated from this upper surface position and a set height between the certain height position of the ran known in advance and the upper surface position of the die.

A plate thickness detection apparatus in a press according to the invention in a sixth aspect, comprises: ram position detection means for detecting upper and lower positions of a ram to which a punch is attached; oil pressure detection means for detecting pressure of hydraulic pressure discharged from a rod-side cylinder chamber of a hydraulic cylinder which vertically moves the ram; a determination section detecting a position at which the punch contacts with a workpiece, from a change of the pressure detected by the oil pressure detection means; and a plate thickness calculation section calculating a plate thickness of the workpiece, from the ram position which is determined by the determination section as position at which the punch contacts with the workpiece and from a set height of a difference between a certain height of the ram known in advance and an upper surface of the die, whereby the ram is vertically moved by the hydraulic cylinder and the workpiece is pressed cooperatively by the punch and the die.

Accordingly, to detect the upper surface position of the workpiece based on which the plate thickness of the workpiece is detected, the oil pressure detection means detects the pressure of the hydraulic oil discharged from the rod-side cylinder chamber of the hydraulic cylinder which vertically moves the ram, the determination section detects the position at which the punch attached to the ram contacts with the workpiece from a change of this detected pressure, and the ram position detection means detects the upper and lower positions of the ram at this time. Therefore, the change of the ram position is detected more sensitively than a case where the pressure of the cylinder-head side cylinder chamber having a large cross-sectional area in the cylinder chamber is detected. In addition, if the upper surface of the workpiece is detected, the plate thickness calculation section calculates the plate thickness of the workpiece based on a set height of a difference between the certain height position of the ram known in advance and the upper surface of the die.

A plate thickness detection apparatus in a press according to the invention in a seventh aspect dependent on the sixth aspect, further comprises: a ram self-weight maximum falling speed calculation section calculating a ram self-weight maximum falling speed at which the work is not bent even if the punch contacts with the workpiece if the ram is to be descended by a self-weight.

With the above-stated configuration, the ram self-weight maximum falling speed calculation section calculating a ram self-weight maximum falling speed at which the work is not bent even if the punch contacts with the workpiece if the ram is to be descended by a self-weight.

Therefore, even if the punch abuts on the workpiece by the descent of the ram, it is possible to prevent the workpiece from being bent.

A plate thickness detection apparatus in a press according to the invention in an eighth aspect, which vertically moves a ram, to which a punch is attached, by a hydraulic cylinder actuated by hydraulic oil from a two-way pump and which presses a workpiece cooperatively by the punch and a die, comprises: ram position detection means for detecting upper and lower positions of the ram; oil pressure detection means, provided halfway along a hydraulic circuit which connects a rod-side cylinder chamber of the hydraulic cylinder which vertically moves the ram, to the two-way pump, for detecting pressure of the hydraulic oil discharged from the rod-side cylinder chamber; a determination section determining a position at which the punch contacts with the workpiece, from a change of the pressure of the hydraulic oil detected by the oil pressure detection means; and a plate thickness calculation section calculating a plate thickness of the workplace, from a ram position which is determined by the determination section as the position at which the punch contacts with the workpiece and from a set height of a difference between a certain height of the ram and an upper surface of the die.

Accordingly, to detect the upper surface position of the workpiece based on which the plate thickness of the workpiece is detected, the oil pressure detection means detects the pressure of the hydraulic oil discharged from the rod-side cylinder chamber of the hydraulic cylinder which vertically moves the ram, the determination section detects the position at which the punch attached to the ram contacts with the workpiece from a change of this detected pressure, and the ram position detection means detects the upper and lower positions of the ram at this time. Therefore, the change of the ram position is detected more sensitively than a case where the pressure of the cylinder-head side cylinder chamber having a large cross-sectional area in the cylinder chamber is detected. In addition, if the upper surface of the workpiece is detected, the plate thickness calculation section calculates the plate thickness of the workpiece based on a set height of a difference between the certain height position of the ram known in advance and the upper surface of the die.

In a plate thickness detection apparatus in a press according to the invention in a ninth aspect dependent on the eighth aspect, the oil pressure detection means detects the pressure of the hydraulic oil discharged from the rod-side cylinder chamber when a speed switch valve provided halfway along the hydraulic circuit is switched to discharge the hydraulic oil from the rod-side cylinder chamber to the two-way pump and to descend the ram by a self-weight.

With the above-stated constitution, the ram to which the punch is attached is descended by the self-weight and the speed switch valve is switched, the pressure of the hydraulic oil discharged from the rod-side cylinder chamber at this time is detected by the oil pressure detection means and the time at which the punch contacts with the workpiece is detected from a change of the detected pressure. While the ram is being descended, the hydraulic oil is not forced into the cylinder head-side cylinder chamber and sucked by negative pressure which is generated by the descent of the piston.

Accordingly, even if the detection that the punch contacts with the workpiece is delayed, only the self-weight of the ram and the like acts on the workplace and it is thereby possible to prevent the workpiece from being bent.

In a plate thickness detection apparatus in a press according to the invention in a tenth aspect dependent on the eighth or ninth aspect, the determination section determines that time at which the pressure of the hydraulic oil discharged from the rod-side cylinder chamber detected by the oil pressure detection means changes from the pressure by a self-weight to atmospheric pressure, as time at which the punch contacts with the workpiece.

Accordingly, the pressure of the hydraulic oil discharged from the rod-side cylinder chamber detected by the oil pressure detection means when the ram is descended, is the pressure following the descent caused by the self-weight of the ram, the punch and the like. However, if the punch contacts with the workpiece, the pressure by the self-weight is eliminated, so that the oil pressure detection means detects atmospheric pressure. Therefore, the determination section can determine that the punch contacts with the workpiece when this atmospheric pressure is detected.

A plate thickness detection apparatus in a press according to the invention in an eleventh aspect dependent on one of the eighth to tenth aspect, further comprises: a ram self-weight maximum falling speed calculation section calculating a ram self-weight maximum falling speed at which the workpiece is not bent even if the punch contacts with the workpiece if the ram is to be descended by the self-weight.

With the above-stated constitution, the ram self-weight maximum falling speed calculation section calculates a ram self-weight maximum falling speed at which the workpiece is not bent even if the punch contacts with the workpiece if the ram is to be descended by the self-weight, and the ram is descended at a falling speed which does not exceed the ram self-weight maximum falling speed.

So, the workpiece is prevented from being bent even though the workpiece is abutted by the punch with the falling ram.

A plate thickness detection apparatus in a press according to the invention in a twelfth aspect, which apparatus vertically moves a ram, to which a punch is attached, and which presses a workpiece cooperatively by the punch and a die, comprises: ram position detection means for descending the ram from a certain height position while controlling a descent speed, and for detecting a ram descent position; a determination section detecting a ram stop position from a change of the ram position detected by the ram position means, and determining this detected stop position as a position at which the punch contacts with the workpiece; and a plate thickness calculation section calculating a plate thickness of the workpiece, from the ram position determined by the determination section as the position at which the punch contacts with the workpiece and from a set height of a difference between the certain height known in advance and an upper surface of the die.

In the plate thickness detection apparatus, therefore, to detect the upper surface position of the workpiece based on which the plate thickness of the workpiece is detected, the ram is descended from a certain height position and by the ram position detection means detects the ram position, the determination section detects a stop position from a change of this detected ram position and determines this stop position as the upper surface of the workpiece. Therefore, the change of the ram position is detected more sensitively than a case where the pressure of the cylinder-head side cylinder chamber having a large cross-sectional area in the cylinder chamber is detected. In addition, the plate thickness calculation section obtains the plate thickness of the workpiece from the detected upper surface position of the workpiece and a set height of a difference between the certain height position of the ram known in advance and the upper surface of the die.

BEST MODES FOR CARRYING OUT THE INVENTION

The embodiments of this invention will be described hereinafter in detail with reference to the drawings.

Figure 2:
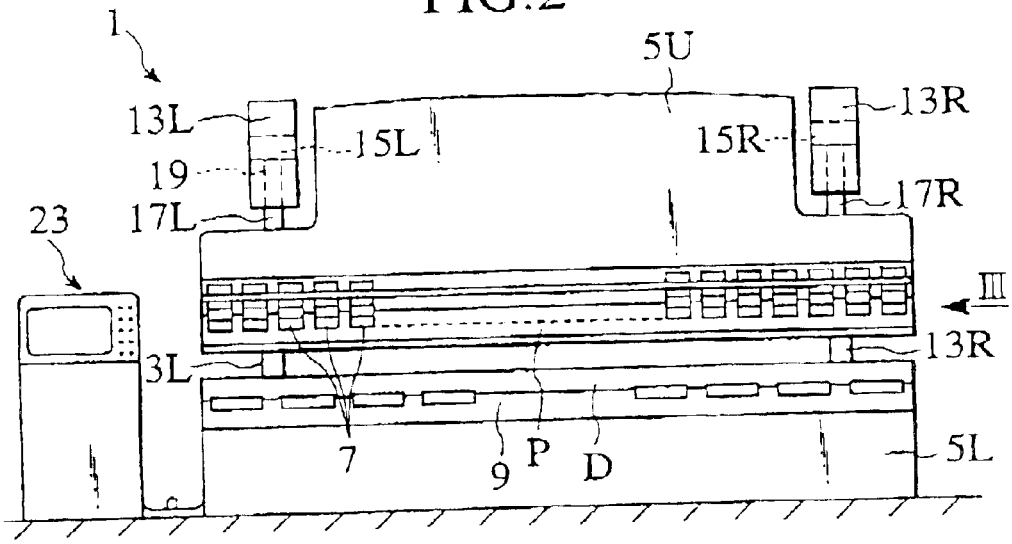
FIG. 2 is a front view showing a press brake which serves as the press according to the present invention.
Figure 3:
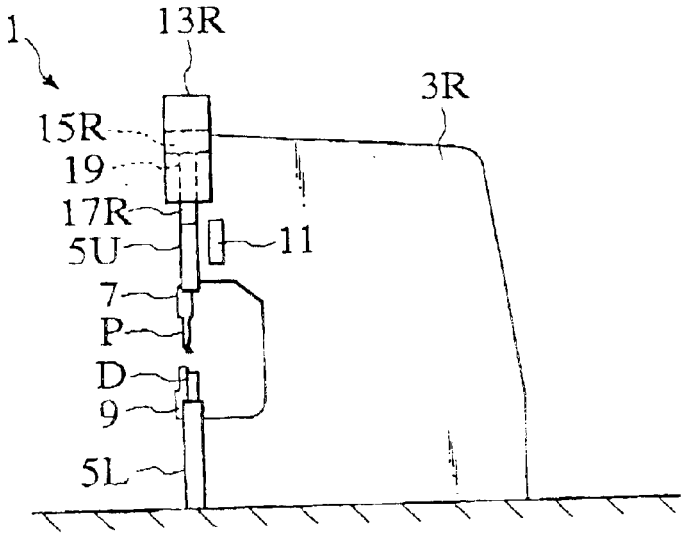
FIG. 3 is a side view taken from a III direction shown in FIG. 2.

FIGS. 2 and 3 show the entirety of a hydraulic press brake 1 as an example of a press. This press brake 1 includes side plates 3L and 3R which are built left and right, respectively, an upper table 5U, serving as a ram, which is vertically movably provided on the upper front end faces of these side plates 3L and 3R, and a lower table 5L which is fixed to the lower front faces of the side plates 3L and 3R.

A punch P is provided on the lower end portion of the upper table 5U through intermediate plates 7 in an exchangeable manner. In addition, a die D is provided on the upper end portion of the lower table 5L through a die space 9 in an exchangeable manner.

A linear scale 11 as an example of ram position detection means (section) for measuring the height position of the upper table 5U, is provided to enable the distance between the upper table 5U and the die D using the known heights of the intermediate plates 7 and the punch P to be obtained.

Hydraulic cylinders 13L and 13R are provided on the upper front surfaces of the left and right side plates 3L and 3R, respectively, and the above-stated upper table 5U is attached to the lower ends of piston rods 17L and 17R which are attached to pistons 15L and 15R of the hydraulic cylinders 13L and 13L, respectively.

Further, a hydraulic sensor 21 (see FIG. 1) as an example of oil pressure detection means (section) for detecting the pressure of hydraulic oil which is discharged from a rod-side cylinder chamber 19 is attached to the rod-side cylinder chamber 19 of each of the hydraulic cylinders 13L and 13R. It is noted that a controller 23 which controls the hydraulic circuit and the like of the press brake 1 is provided to be adjacent the press brake 1.

Next, the hydraulic circuits of the hydraulic cylinders 13L and 13R and the controller 23 will next be described with reference to FIG. 1. Since the same hydraulic circuit is provided for each of the left and right hydraulic cylinders 13L and 13R, the right-side hydraulic cylinder 13R and the hydraulic circuit therefor will be described herein.

The cylinder head-side cylinder chamber 25 of the hydraulic cylinder 13R which vertically moves the upper table 5U serving as a ram, is connected to one side of a two-way pump 29, which serves as a hydraulic pump, through a piping 27. A piping 31 is provided halfway along the piping 27 and connected to an oil tank 35 through a check valve 33. It is noted that the two-way pump 29 is actuated by a servo motor 37. Further, the cylinder head-side cylinder chamber 25 is connected to the oil tank 35 through a pre-fill valve 40 by a piping 39. A switch valve 41 is provided halfway along the piping 27 to communicate with the oil tank 35 through a piping 42.

On the other hand a piping 43 is connected to the rod-side cylinder chamber 19 of the hydraulic cylinder 13R, and a counterbalance valve 45 and a speed switch valve 47 are provided in parallel. The counterbalance valve 45 and speed switch valve 47 are connected to the other side of the two-way pump 29 by a piping 49.

Further, a piping 51 is connected halfway along the piping 49 and connected to the oil tank 35 through a check valve 53. It is noted that a hydraulic sensor 21 which detects the pressure of hydraulic oil discharged from the rod-side cylinder chamber 19 is provided halfway along the piping 49.

With the above-stated configuration, to conduct bending if the two-way pump 29 is rotated in forward direction by the rotation of the servo motor 37 and the hydraulic oil is supplied from the oil tank 35 to the cylinder head-side cylinder chamber 25 through the check valve 53, the switch valve 41 and the piping 27, then the piston 15R descends to thereby descend the upper table 5U and the punch P. The hydraulic oil of the rod-side cylinder chamber 19 is returned to the two-way pump 29 through the piping 43, the counterbalance valve 45 and the piping 49 and similarly supplied to the cylinder head-side cylinder chamber 25.

On the other hand if the two-way pump 29 is rotated in an opposite direction by the servo motor 37, the hydraulic oil is supplied from the oil tank 35 to the rod-side cylinder chamber 19 through the check valve 33, the piping 49 and the check valve of the speed switch valve 47, whereby the piston rod 17 ascends to thereby ascend the upper table 5U and the punch P.

It is noted that the upper and lower positions of the upper table 5U are detected by the linear scale 11. Further, if the pressure of the rod-side cylinder chamber 19 becomes higher, than a predetermined value, the pre-fill valve 40 is opened in response to a pilot signal 55 and the hydraulic oil is directly fed to the oil tank 35 from the cylinder head-side cylinder chamber 25 through the pre-fill valve 40.

In the controller 23, an input means 59 such as a keyboard for inputting various data and an output means 61 such as a CRT for outputting various data are connected to a CPU 57 which is a central processing unit. In addition, the linear scale 11 and the hydraulic sensor 21 are connected to the CPU 57 and the detection signals for the upper and lower positions of the upper table 5U and the pressure of the hydraulic oil discharged from the rod-side cylinder chamber 19 are fed to the CPU 57.

Furthermore, a memory 63 which stores input data, working program and the like, a determination section 65 which determines whether or not the punch P contacts with a workpiece W, and a plate thickness calculation section 67 which calculates the plate thickness of the workpiece W from the position at which the punch P contacts with the workpiece W, i.e., the distance between the upper surface of the workpiece W and that of the die D, are connected to the CPU 57.

Figure 4:
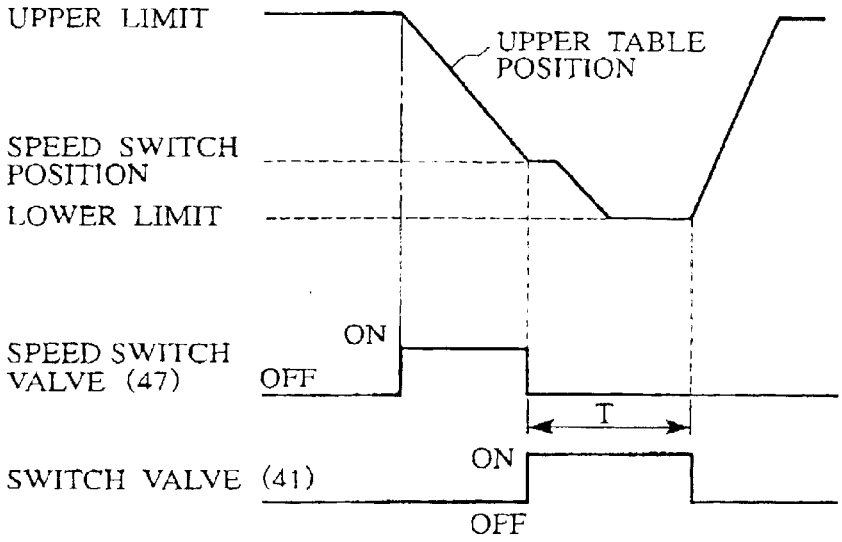
FIG. 4 is a time chart showing the operation of a ram.

FIG. 4 shows a time chart showing the vertical movement of the upper table 5U and the state of the speed switch valve 47 for the ordinary operations of the upper table 5U serving as a ram and the punch P. Namely, the speed switch valve 47 is switched to be turned on so as to descend the upper table 5U which is located at an upper limit position. If the upper table 5U reaches a predetermined speed switch position, the speed switch valve 47 is turned off. During time T from this moment until the upper table 5U reaches a lower limit position and then ascends, the hydraulic oil is fed from the two-way pump 29 to the cylinder head-side cylinder chamber 25 and the hydraulic oil of the rod-side cylinder chamber 19 returns to the two-way pump 29 through the counterbalance valve 45. It is noted that the switch valve 41 is turned on during the time T.

Figure 5:
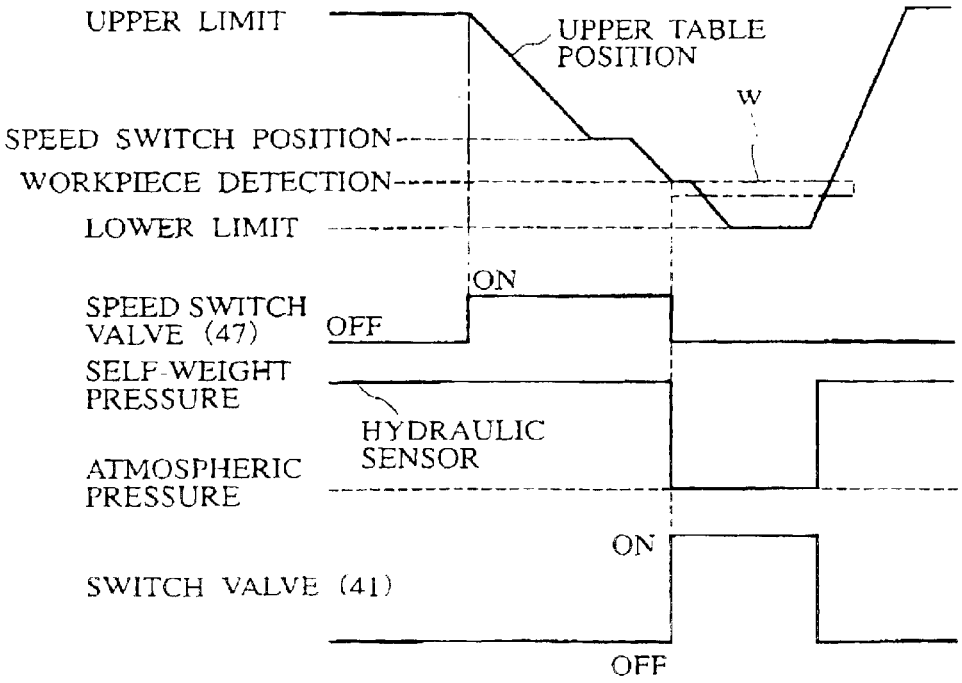
FIG. 5 is a time chart showing the operation of the ram in a plate thickness detection method for the press according to the present invention.

On the other hand, FIG. 5 shows a time chart showing the vertical movement of the upper table 5U, the state of the speed switch valve 47 and the pressure state of the rod-side cylinder chamber 19 for a plate thickness detection method according to this invention.

Here, the cross-sectional area of the rod-side cylinder chamber 19 is smaller than that of the cylinder head-side cylinder chamber 25 (e.g., with a ratio of about 1:10). Therefore, paying attention to the fact that a change in the pressure of the hydraulic oil discharged from the rod-side cylinder chamber 19 is sensitive, the pressure of the hydraulic oil discharged from the rod-side cylinder chamber 19 (lowest stage in FIG. 5) is monitored.

First, the rapid descent of the upper table 5U is started from a certain height position at which a height is known, e.g., the upper limit position by turning on the speed switch valve 47. If the upper table 5U reaches the predetermined speed switch position, the discharge quantity of the two-way pump 29 is decreased under the control of the servo motor 37 to switch to a bending operation. If it is detected that the punch P contacts with the workpiece W, the speed switch valve 47 is switched to be turned off.

Since the cylinder head-side cylinder chamber 25 is not pressurized and the piston 15 is descended by the self-weight of the upper table 5U, the punch P and the like, the hydraulic oil is sucked into the cylinder head-side cylinder chamber 25 by negative pressure and the hydraulic oil of the rod-side cylinder chamber 19 is discharged. Accordingly, the hydraulic sensor 21 detects pressure by the self-weight of the upper table 5U, the punch P and the like until the punch contacts with the workpiece W. If the punch P contacts with the workpiece W, the descent of the piston 15 is stopped. Therefore, the pressure suddenly decreases to atmospheric pressure.

The determination section 65 determines that the time at which the pressure of the rod-side cylinder chamber 19 becomes equal to the atmospheric pressure is the time at which the punch P contacts with the workpiece W. The height position H1 of the upper table 5U at this time is detected by the linear scale 11. The plate thickness calculation section 67 calculates the plate thickness d of the workpiece W from the difference H0 between the upper limit position of the upper table 5U and height to the upper surface position of the die D which is stored in the memory 63 in advance and the height position H1 of the upper table 5U by a formula of d=H0−H1 (see FIG. 6).

Thereafter, the speed switch valve 47 is switched to be turned off and the hydraulic oil is supplied to the cylinder head-side cylinder chamber 25 to thereby start pressing the workpiece W according to the detected plate thickness. It is noted that since the hydraulic oil of the rod-side cylinder chamber 19 is returned to the two-way pump 29 through the counterbalance valve 45, the pressure of the pressure sensor 21 is equal to the suction pressure of the two-way pump 29.

As can be seen from these results, the upper table 5U is descended by the self-weight of the upper table 5U, the punch P and the like and the change of the pressure of the rod-side cylinder chamber 19 to negative pressure when descending the upper table 5U is detected and the time at which the punch P contacts with the workpiece W from the pressure change. Therefore, even if detection speed is slow, the oil escapes into the oil tank 35 by turning off the switch valve 41, whereby the switch valve 41 is turned on after detecting the plate thickness and the oil is supplied to the cylinder head-side cylinder chamber 25. Since no bending load is imposed on the workpiece W, it is possible to prevent the deformation of the workpiece W. Further, since the determination is based on the pressure of the rod-side cylinder chamber 19 having a small cross-sectional area in the cylinder chamber, it is possible to make the determination more accurately.

Next, a method for controlling ram self-weight falling speed where the workpiece W may possibly be bent when the punch P contacts with the workpiece W and when the workplace W is thin or the bending length is small according to the descent of the upper table 5U by self-weight, will be described hereinbelow.

Figure 1:
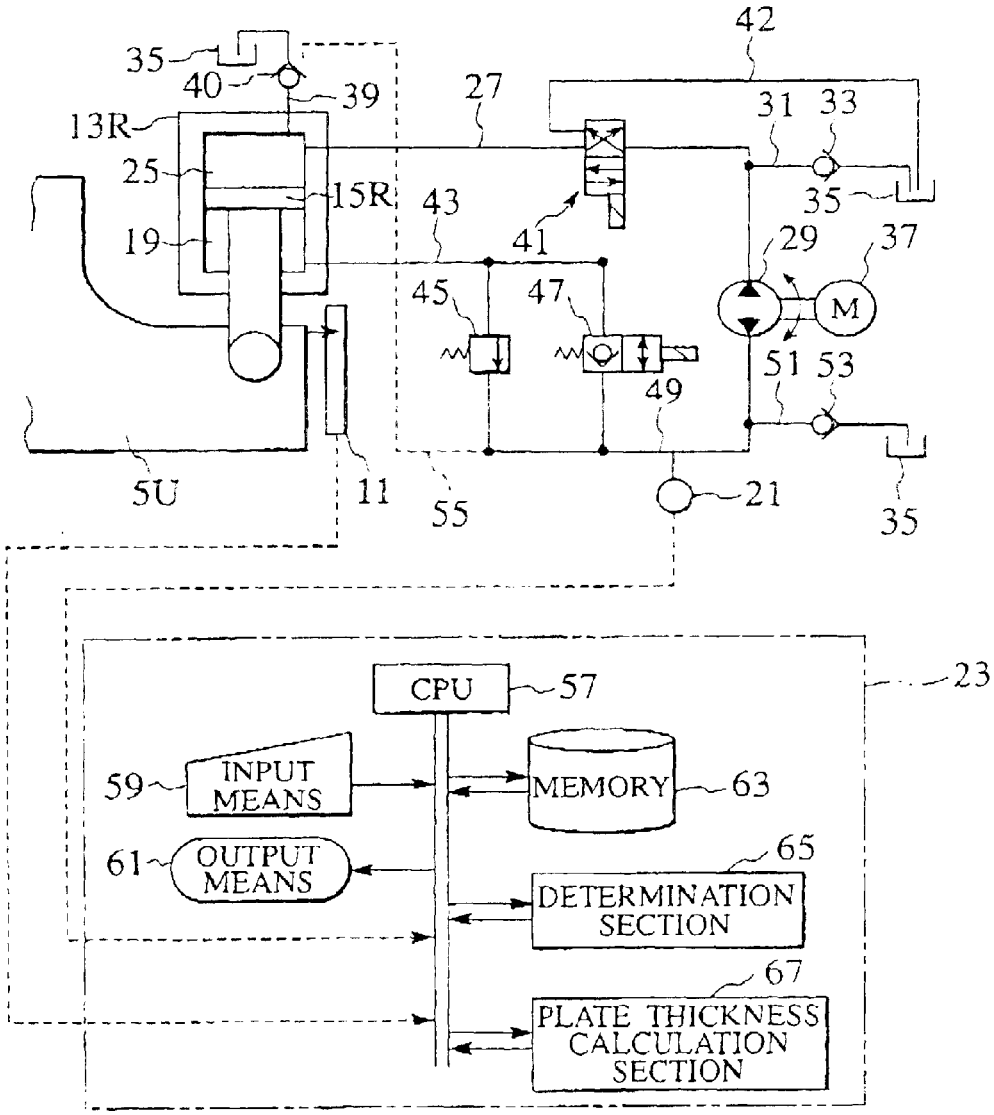
FIG. 1 is a hydraulic circuit diagram and a control block diagram showing a plate thickness detection apparatus in a press according to the present invention.
Figure 7:
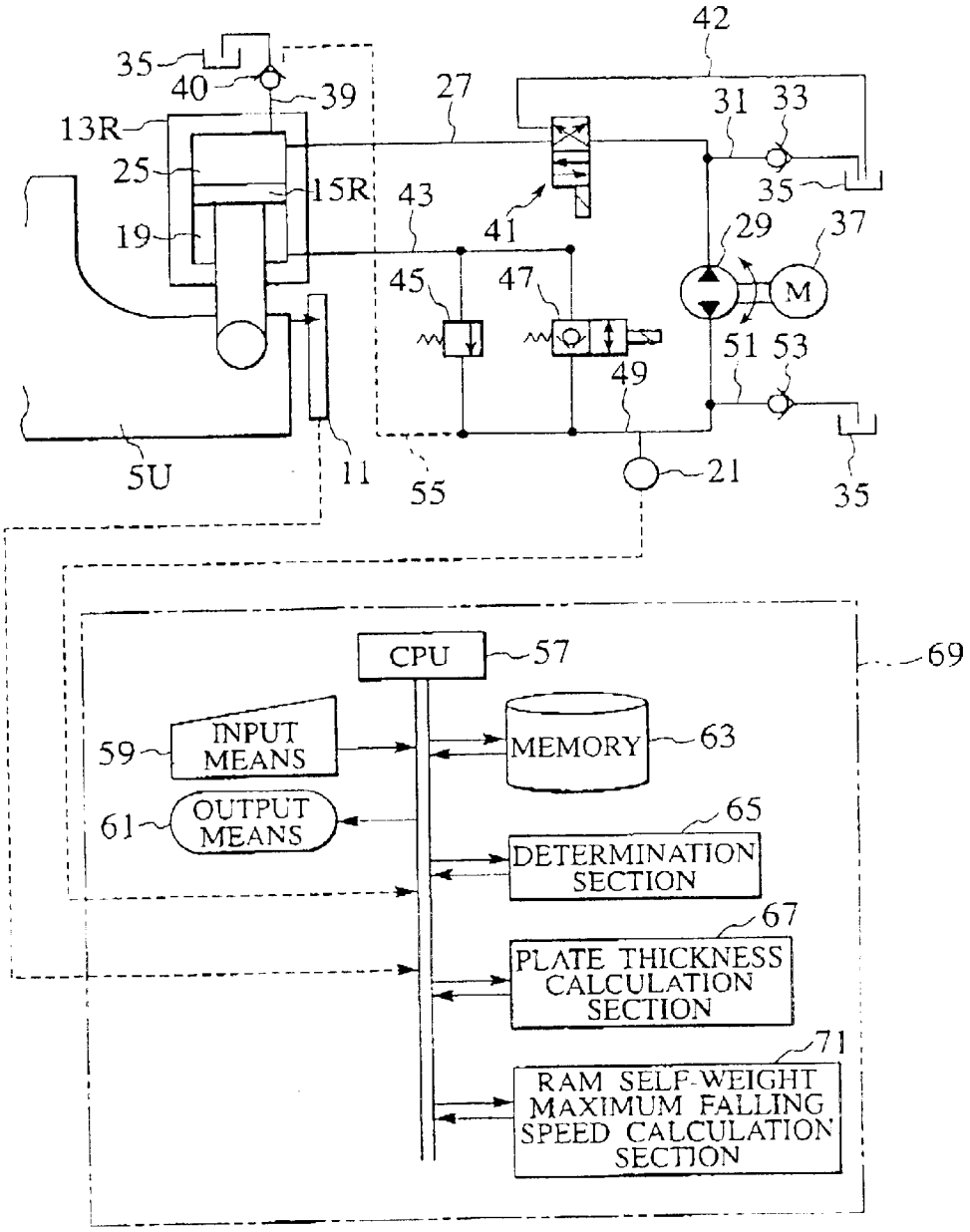
FIG. 7 is a hydraulic circuit diagram and a control block diagram showing another embodiment of a plate thickness detection apparatus in a press according to the present invention.

Referring to FIG. 7, a controller 69 employed in this case is constituted so that a ram self-weight maximum falling speed calculation section 71 is added to the controller 23 shown in FIG. 1. Since the other constituent elements of the controller 69 are the same as those shown in FIG. 1, they are denoted by the same reference symbols, respectively and repetitive description will not be given herein.

This ram self-weight maximum falling speed calculation section 71 calculates a maximum falling speed by the self-weight of the upper table 5U and the like at which speed the workpiece W is not bent when the upper table 5U falls to thereby contact the punch P with the workpiece W, from input workpiece conditions and the already known self-weights of the upper table 5U, the punch P and the like.

Figure 8:
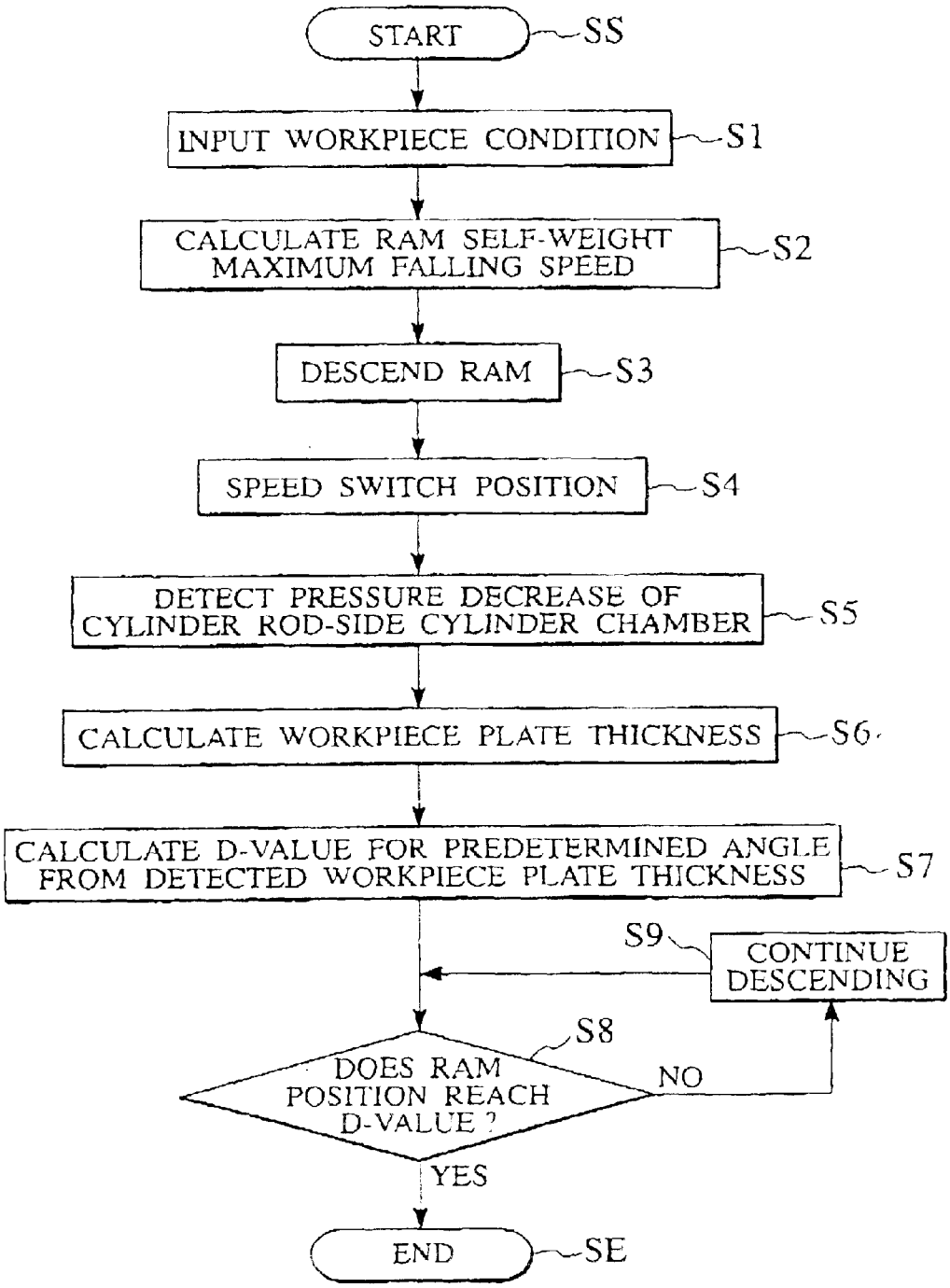
FIG. 8 is a flow chart showing another embodiment of a plate thickness detection method for the press according to the present invention.

A plate thickness detection method using such a controller 69 will be described with reference to FIG. 8. First, when the controller 69 starts (at a step SS), workpiece conditions such as the nominal thickness, bending length and tensile strength of the workpiece W are input from the input means 59 (at a step S1). The ram self-weight maximum falling speed calculation section 71 calculates a ram maximum self-weight falling speed from the input workpiece conditions and the self-weight of the ram such as those of the upper table 5U, the punch P and the like (at a step S2).

That is, a maximum value of the ram self-weight falling speed (i.e., bending speed) to satisfy the following expression (1) may be obtained.

Bending pressure required for bending=f(workpiece nominal plate thickness, bending length, tensile strength) >ram self-weight (ton)×bending speed (mm/s). . . (1).

The upper table 5U is descended by the self-weight at a self-weight falling speed which does not exceed the obtained ram maximum self-weight falling speed (at a step S3). Here, the ram self-weight falling speed can be adjusted so as not to exceed the ram maximum self-weight falling speed, by turning OFF the switch valve 41 on the head side of the two-way pump 29, connecting the cylinder head-side cylinder chamber 25 to the tank 35 and controlling the revolution of the two-way pump 29. If the two-way pump is not employed, the ram self-weight falling speed can be controlled by switching the state of an ascent/descent switching electromagnetic proportional valve to a descent step and finely adjusting the aperture and diaphragm of a spool.

If the upper table 5U is descended at the ram self-weight maximum falling speed and reaches a predetermined speed switch position as in the case of the preceding embodiment, then the speed switch valve 47 is switched (at a step S4) and the determination 65 determines that the time at which the pressure of the rod-side cylinder chamber 19 becomes equal to the atmospheric pressure is the time at which the punch P contacts with the workplace W (at a step S5).

Figure 6:
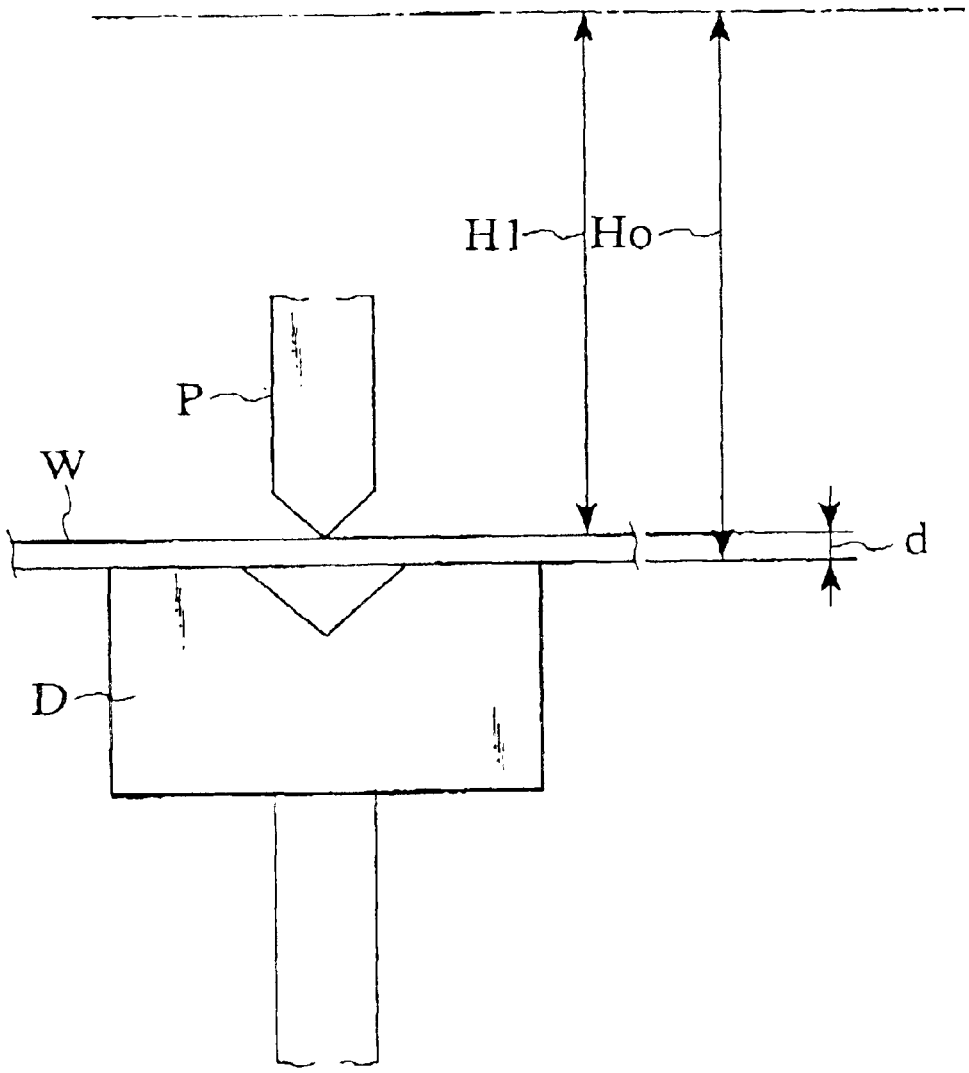
FIG. 6 is an explanatory view for calculating the plate thickness of a workpiece from the upper surface position of the workpiece detected as the upper limit position of an upper table.

Referring to FIG. 6, the position H1 of the upper table 5U at this time is detected by the linear scale 11, and the plate thickness d of the workpiece W is calculated from the difference H0 between the upper limit position of the upper table 5U and height to the upper surface position of the die D which is stored in the memory 63 in advance by d=H0−H1 (at a step S6). At this moment, the switch valve 41 is turned ON and the two-way pump 29 is actuated to turn into a state in which the two-way pump 29 can supply the hydraulic oil to the cylinder head-side cylinder chamber 25.

A D-value for bending the workpiece w at a predetermined angle is calculated for the detected workpiece plate thickness d (at a step S7), and the upper table 5U is descended (at a step S9) until the position of the upper table 5U detected by the linear scale 11 becomes equal to the calculated D-value (at a step S8) and then a pressurization operation is finished (at a step SE).

As is obvious from these results, if the workpiece W is thin, the bending length thereof is small or the like and the upper table 5U is descended by the self-weights of the upper table 5U, the punch P and the like, the upper table 5U is descended at a speed which does not exceed the ram self-weight maximum falling speed. Therefore, it is possible to detect the plate thickness of the workpiece W in the shortest time without bending the workpiece W when the punch P contacts with the workpiece W. Further, by utilizing this plate thickness detection method for bending, it is possible to shorten bending tact time.

It is noted that this invention is not limited to the above-stated embodiments but can be carried out by other embodiments by making appropriate changes thereto. Namely, in the above-stated embodiment, the press brake 1 has been described as an example of the press. However, this invention is also applicable to other presses.

Further, the ram is descended from a certain position of a height which is known, this ram position is detected by the ram position detection means, the determination section determines the position at which the descent of the ram is stopped as a position at which the punch contacts with the workpiece, from the detected ram position, and the plate thickness calculation means can thereby obtain the plate thickness of the workpiece from the ram stop position at this moment, and a set height between the certain height of the ram which is known in advance and the upper surface of the die. While the stop of the ram descent is detected by a change in the ram position detected by the ram position detection means, it can be also detected from a deviation between the detected ram position and an indication value.

What is claimed is:

1. A plate thickness detection method for a press, comprising the steps of:

descending a ram from a certain height position;

detecting pressure of hydraulic oil discharged from a rod-side cylinder chamber at this time;

detecting time at which a punch contacts with a workpiece on the die, from a change of the detected pressure;

detecting upper and lower positions of the ram at this time;

obtaining a plate thickness of the workpiece from the detected height position of the ram and a set height between the certain height known in advance and an upper surface of the die; and vertically moving the ram, to which the punch is attached, based on the obtained plate thickness of the workpiece, and pressing the workpiece cooperatively by the punch and the die.

2. A plate thickness detection method for a press according to claim 1, wherein the ram is descended by a self-weight;

the pressure of the hydraulic oil discharged from the rod-side cylinder chamber at this time is detected; and the time at which the punch contacts with the workpiece is detected from the change of the detected pressure.

3. A plate thickness detection method for a press according to claim 2, wherein if the ram is to be descended by the self-weight, the ram is descended at a speed equal to or lower than a ram self-weight maximum falling speed at which the workpiece is not bent even if the punch contacts with the workpiece.

4. A plate thickness detection method for a press according to claim 3, wherein time at which the pressure of the hydraulic oil discharged from the rod-side cylinder chamber changes from the pressure by the self-weight to atmospheric pressure, is detected as the time at which the punch contacts with the workpiece.

5. A plate thickness detection method for a press, comprising the steps of:

descending a ram from a certain height position while controlling a descent speed, and detecting a ram descent position;

detecting a ram stop position from a change of this detected ram position;

determining the detected stop position as a position at which a punch contacts with a workpiece on the die;

obtaining a plate thickness of the workpiece from the ram position which is determined as the position at which the punch contacts with the workpiece, and from a set height of a difference between the certain height known in advance and an upper surface of the die; and vertically moving the ram, to which the punch is attached, based on the obtained plate thickness of the workpiece, and pressing the workpiece cooperatively by the punch and the die.

6. A plate thickness detection apparatus in a press, the detection apparatus comprising:

ram position detection section to detect upper and lower positions of a ram to which a punch is attached;

oil pressure detection section to detect pressure of hydraulic pressure discharged from a rod-side cylinder chamber of a hydraulic cylinder which vertically moves the ram;

a determination section detecting a position at which the punch contacts with a workpiece, from a change of the pressure detected by the oil pressure detection section; and a plate thickness calculation section calculating a plate thickness of the workpiece, from the ram position which is determined by the determination section as position at which the punch contacts with the workpiece and from a set height of a difference between a certain height of the ram known in advance and an upper surface of the die, wherein the ram is thereby vertically moved by the hydraulic cylinder, and the workpiece is pressed cooperatively by the punch and the die.

7. A plate thickness detection apparatus in a press according to claim 6, further comprising:

a ram self-weight maximum falling speed calculation section calculating a ram self-weight maximum falling speed at which the work is not bent even if the punch contacts with the workpiece if the ram is to be descended by a self-weight.

8. A plate thickness detection apparatus in a press, which vertically moves a ram, to which a punch is attached, by a hydraulic cylinder actuated by hydraulic oil from a two-way pump and which presses a workpiece cooperatively by the punch and a die, the apparatus comprising:

ram position detection section to detect upper and lower positions of the ram;

oil pressure detection section, provided halfway along a hydraulic circuit which connects a rod-side cylinder chamber of the hydraulic cylinder which vertically moves the ram, to the two-way pump, for detecting pressure of the hydraulic oil discharged from the rod-side cylinder chamber;

a determination section determining a position at which the punch contacts with the workpiece, from a change of the pressure of the hydraulic oil detected by the oil pressure detection section; and a plate thickness calculation section calculating a plate thickness of the workpiece, from a ram position which is determined by the determination section as the position at which the punch contacts with the workpiece and from a set height of a difference between a certain height of the ram and an upper surface of the die.

9. A plate thickness detection apparatus in a press according to claim 8, wherein the oil pressure detection section detects the pressure of the hydraulic oil discharged from the rod-side cylinder chamber when a speed switch valve provided halfway along the hydraulic circuit is switched to discharge the hydraulic oil from the rod-side cylinder chamber to the two-way pump and to descend the ram by a self-weight.

10. A plate thickness detection apparatus in a press according to claim 9, wherein the determination section determines that time at which the pressure of the hydraulic oil discharged from the rod-side cylinder chamber detected by the oil pressure detection section changes from the pressure by a self-weight to atmospheric pressure, as time at which the punch contacts with the workpiece.

11. A plate thickness detection apparatus in a press according to claim 10, further comprising:

a ram self-weight maximum falling speed calculation section calculating a ram self-weight maximum falling speed at which the workpiece is not bent even if the punch contacts with the workpiece if the ram is to be descended by the self-weight.

12. A plate thickness detection apparatus in a press, which apparatus vertically moves a ram, to which a punch is attached, and which presses a workpiece cooperatively by the punch and a die, the apparatus comprising:

ram position detection section to descend the ram from a certain height position while controlling a descent speed, and for detecting a ram descent position;

a determination section detecting a ram stop position from a change of the ram position detected by the ram position section, and determining this detected stop position as a position at which the punch contacts with the workpiece; and a plate thickness calculation section calculating a plate thickness of the workpiece, from the ram position determined by the determination section as the position at which the punch contacts with the workpiece and from a set height of a difference between the certain height known in advance and an upper surface of the die.

* * * * *

UNITED STATES PATENT AND TRADEMARK OFFICE

CERTIFICATE OF CORRECTION

PATENT NO. : 6,826,939 B2
DATED : December 7, 2004
INVENTOR(S) : K. Kanno

It is certified that error appears in the above-identified patent and that said Letters Patent is hereby corrected as shown below:

Title page,
Item [54], Title, "DETACHING" should be -- DETECTING --.

Signed and Sealed this

Twenty-third Day of August, 2005

JON W. DUDAS
*Director of the United States Patent and Trademark Office*